US011442410B2

(12) United States Patent
Jacquot

(10) Patent No.: US 11,442,410 B2
(45) Date of Patent: Sep. 13, 2022

(54) ROTATING-BEZEL SYSTEM COMPRISING A CERAMIC ROTATING BEZEL

(71) Applicant: Comadur SA, Le Locle (CH)

(72) Inventor: Emmanuel Jacquot, Grand'Combe-Chateleu (FR)

(73) Assignee: Comadur SA, Le Locle (CH)

( * ) Notice: Subject to any disclaimer, the term of this patent is extended or adjusted under 35 U.S.C. 154(b) by 9 days.

(21) Appl. No.: 17/027,777

(22) Filed: Sep. 22, 2020

(65) Prior Publication Data

US 2021/0173345 A1 Jun. 10, 2021

(30) Foreign Application Priority Data

Dec. 4, 2019 (EP) ..... 19213595

(51) Int. Cl.
*G04B 19/28* (2006.01)
*G04B 37/00* (2006.01)

(52) U.S. Cl.
CPC ..... *G04B 19/286* (2013.01); *G04B 37/0008* (2013.01)

(58) Field of Classification Search
CPC ..... G04B 37/0008; G04B 19/286; G04B 19/283; G04B 19/18; G04R 60/08; G04G 21/04
USPC ..... 368/295
See application file for complete search history.

(56) References Cited

U.S. PATENT DOCUMENTS 5,798,984 A * 8/1998 Koch ..... H01Q 1/273 368/10
11,163,265 B2 * 11/2021 Della Santa ..... G04B 19/283
2011/0259753 A1 * 10/2011 Grossenbacher ..... G04B 19/18 205/162
2013/0208577 A1 * 8/2013 Netuschill ..... G04B 19/18 368/285

(Continued)

FOREIGN PATENT DOCUMENTS

CH 714 803 A2 9/2019
CN 101365992 A 2/2009
CN 202975603 U 6/2013

(Continued)

OTHER PUBLICATIONS

European Search Report dated May 20, 2020 in European Application 19213595.2 filed Dec. 4, 2019 (with English Translation of Categories of Cited Documents), 3 pages.

(Continued)

*Primary Examiner* — Edwin A. Leon
(74) *Attorney, Agent, or Firm* — Oblon, McClelland, Maier & Neustadt, L.L.P.

(57) ABSTRACT

A rotating-bezel system intended to be mounted for rotation on a watch-case middle inside which a horological movement is housed, including a ceramic rotating bezel, an annular ring intended to cooperate with an element angularly secured to the middle, and an annular joint for connection between the rotating bezel and the annular ring, the annular ring being placed in the rotating bezel. According to the invention, the system further includes at least one element (Continued)

for locking the annular ring on the rotating bezel, and at least one element being configured to lock any relative rotation between the annular ring and the bezel and to thus angularly secure the assembly formed by the ring and the bezel.

11 Claims, 3 Drawing Sheets

(56) References Cited

U.S. PATENT DOCUMENTS

| | | | |
|---|---|---|---|
| 2019/0271954 | A1 | 9/2019 | Silvant et al. |
| 2019/0294115 | A1 | 9/2019 | Silvant |

FOREIGN PATENT DOCUMENTS

| | | | |
|---|---|---|---|
| CN | 103207559 | A | 7/2013 |
| CN | 104412176 | A | 3/2015 |
| CN | 105988358 | A | 10/2016 |
| CN | 108027591 | A | 5/2018 |
| CN | 110308637 | A | 10/2019 |
| CN | 110308640 | A | 10/2019 |
| EP | 0 436 468 | A1 | 7/1991 |
| EP | 3 141 969 | A1 | 3/2017 |
| EP | 3 543 799 | A1 | 9/2019 |
| JP | 2000-98060 | A | 4/2000 |
| JP | 2013-145234 | A | 7/2013 |
| JP | 2015-518967 | A | 7/2015 |
| JP | 2019-164131 | A | 9/2019 |
| KR | 10-2008-0108217 | A | 12/2008 |
| KR | 10-2019-0110445 | A | 9/2019 |

OTHER PUBLICATIONS

Notice of the Reason for Refusal dated Sep. 21, 2021 in Japanese Patent Application No. 2020-167445 (with English language translation), 8 pages.

Combined Chinese Office Action and Search Report dated Oct. 21, 2021 in corresponding Chinese Patent Application No. 202011094126.1 (with English Translation and English Translation of Category of Cited Documents), 11 pages.

Notice of Grounds for Rejection dated Apr. 6, 2022 in Korean Patent Application No. 10-2020-0130273 (with English language translation), 10 pages.

Chinese Office Action issued in Chinese Patent Application No. 2020110941261 dated Jun. 6, 2022, (w/ English Translation).

* cited by examiner

ROTATING-BEZEL SYSTEM COMPRISING A CERAMIC ROTATING BEZEL

CROSS-REFERENCE TO RELATED APPLICATION

This application claims priority to European Patent Application No. 19213595.2 filed on Dec. 4, 2019, the entire disclosure of which is hereby incorporated herein by reference.

TECHNICAL FIELD OF THE INVENTION

The invention relates to a rotating-bezel system comprising a ceramic rotating bezel.

The invention also relates to a watch case comprising a middle and the rotating-bezel system mounted for rotation on the middle.

The invention also relates to a watch including the watch case.

PRIOR ART

Known rotating-bezel systems comprise a ceramic rotating bezel, an annular ring, and an annular connecting joint between the rotating bezel and the annular ring. In such a system, the annular ring is generally driven into the rotating bezel. The annular ring is intended to cooperate with an element angularly secured to a watch-case middle on which the ceramic rotating bezel is mounted, such as an open spring with faces.

The annular joint is inserted between the annular ring and the rotating bezel, and forms a friction element configured to hold the bezel on the annular ring. However, one drawback of such a rotating-bezel system is that the annular joint does not provide a sufficiently strong connection between the rotating bezel and the ring, in particular when the system is dismantled. However, during such a dismantling operation, for example necessary for replacing a part or for repairing an element, such a weakness of connection provided by the annular joint may result in the bezel becoming disengaged from the ring, the latter then remaining on the middle of the watch case. This gives rise to unnecessary and tedious operations for the operator responsible for dismantling the system, which is detrimental to the practicality and reliability of the latter.

SUMMARY OF THE INVENTION

The aim of the invention is therefore to provide a simple and reliable rotating-bezel system for securing the holding of the rotating bezel on the annular ring, in particular when the system is dismantled, and overcoming the aforementioned drawbacks of the prior art.

To this end, the invention relates to a rotating-bezel system that comprises a ceramic rotating bezel, an annular ring configured to cooperate with an element angularly secured to the middle, an annular joint for connection between the rotating bezel and the annular ring, the annular ring being placed in the rotating bezel, and at least one element for locking the annular ring on the rotating bezel, the at least one element being configured to lock any relative rotation between the annular ring and the bezel and thus to angularly secure the assembly formed by the ring and the bezel.

Particular embodiments of the system include additional features described hereinafter.

By virtue of the presence in the system of at least one element for locking the annular ring on the rotating bezel, the holding of the rotating bezel on the annular ring is improved, in particular when the system is dismantled. This is because the or each locking element is configured to lock any relative rotation between the ring and the bezel. Such a configuration then makes it possible to angularly secure the assembly formed by the ring and the bezel, thus making it possible to avoid any disengagement between them, in particular during dismantling, and thus securing the holding of the assembly. The reliability of the system is thus advantageously improved.

Advantageously, the system comprises at least two locking elements distributed over 360°. This distributes the mechanical stresses exerted on the system as well as limiting the clearance between the annular ring and the rotating bezel. According to a preferential embodiment of the invention, the system comprises four locking elements distributed over 360°, the four locking elements being spaced apart, two by two, by 90°.

Advantageously, the annular joint is formed by a polymer material, for example asutane. The joint being made from flexible material, it can deform and compress, and thus makes it possible to compensate for clearances and to clamp (secure) the parts together.

Advantageously, at least one opening for receiving the or one of the locking elements is machined locally in the annular ring. This facilitates the installation of the locking element or elements in the system.

Advantageously, the annular joint is driven between the annular ring and the or each locking element. Such an annular joint thus configured makes it possible to form a friction element for preventing any sliding between the locking element or elements and the annular ring, and furthermore prevents non-return of the locking elements.

Advantageously, the annular rotating bezel system is formed by an independent module, said module being configured to be snapped onto the middle. This makes it possible to obtain simple and practical mounting of the rotating-bezel system on the middle, also allowing easy dismantling. This further simplifies the assembly and dismantling of the system. The system of mounting by snapping on used forms a free hooking system, and the principles of normal mounting of rotating bezels with a spring with faces is kept.

To this end, the invention also relates to a watch case comprising a middle as well as the rotating-bezel system described above.

To this end, the invention also relates to a watch including the watch case described above.

BRIEF DESCRIPTION OF THE FIGURES

The aims, advantages and features of the rotating-bezel system according to the invention will emerge more clearly in the following description on the basis of at least one non-limitative embodiment illustrated by the drawings, in which.

DETAILED DESCRIPTION OF THE INVENTION

Figure 1:
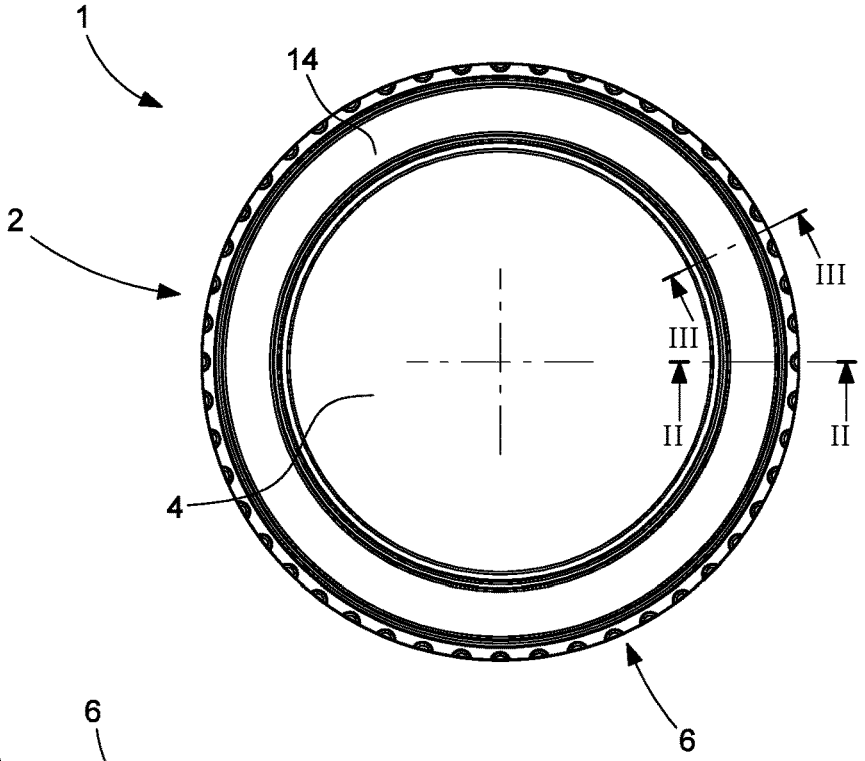
FIG. 1 is a plan view of a watch case equipped with a rotating-bezel system according to the invention.
Figure 2:
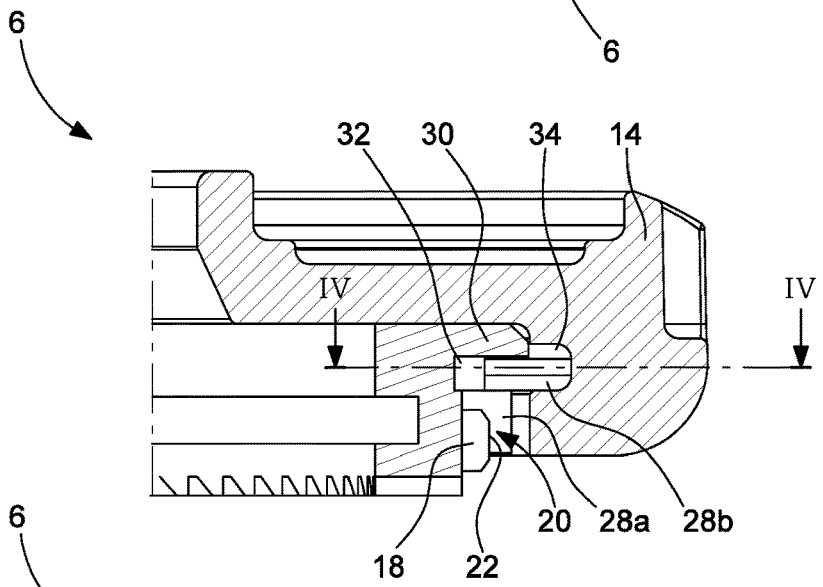
FIG. 2 is a view in cross section of the system in FIG. 1, taken along a cross-sectional plane II-II, the system comprising a ceramic rotating bezel, an annular ring and an element for locking the annular ring on the rotating bezel.
Figure 3:
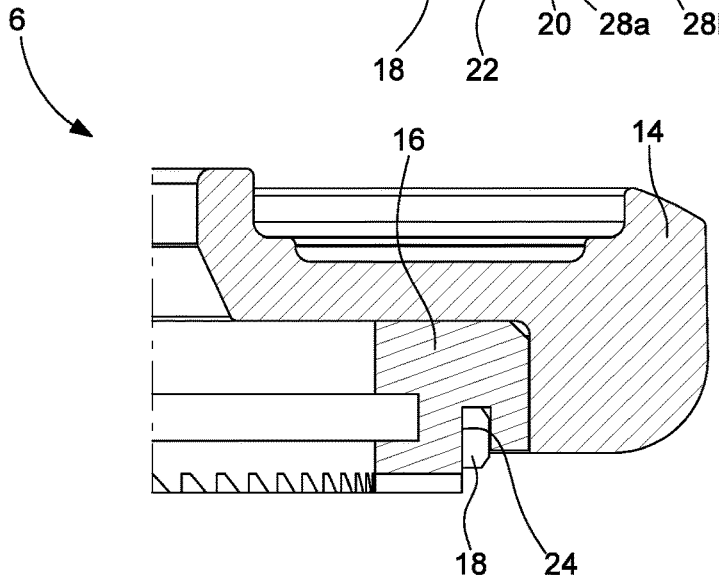
FIG. 3 is a view in cross section of the system of FIG. 1, taken along a cross-sectional plane III-III.

FIG. 1 shows a watch 1 provided with a watch case 2. The watch case 2 typically comprises a middle 4. The watch case 2 also comprises a rotating-bezel system 6 as well as a horological movement, the horological movement not being shown in the figures for reasons of clarity. The rotating-bezel system 6 is mounted for rotation on the middle 4. Preferably, as illustrated in FIGS. 1 to 3, the rotating-bezel system 6 is formed by an independent module.

As illustrated in FIG. 1, the middle 4 is annular in shape. Preferably, the middle 4 carries an annular element secured to it, this element not being shown in the figures for reasons of clarity. The element angularly secured to the middle 4 is for example a spring ring with faces, without this being limitative in the context of the present invention. In the watch case 2 taken as an example in FIGS. 1 to 11, the configuration of the watch case is substantially circular. However, the invention is in no way limited to such a configuration of the watch case.

The rotating-bezel system 6 comprises a rotating bezel 14, an annular ring 16, an annular joint 18 for connection between the rotating bezel 14 and the annular ring 16, and at least one element 20 for locking the annular ring 16 on the rotating bezel 14. Preferably, the system 6 includes at least two locking elements 20 distributed over 360°. According to a preferential embodiment, the system 6 includes four locking elements 20 distributed over 360°, the four locking elements 20 being spaced apart, two by two, by 90°. The rotating bezel 14 is made from ceramic, typically based on alumina, zirconia or silicon nitride.

The annular ring 16 is placed in the rotating bezel 14, and cooperates with the element angularly secured to the middle 4. In the particular example embodiment illustrated in FIGS. 2 to 11, the annular ring 16 is a toothed ring, preferably made from metal. According to this particular example embodiment, the annular ring 16 is then in engagement with teeth of the element angularly secured to the middle 4.

As illustrated in FIGS. 2, 3, 6, 7 and 9, at least one opening 22 for receiving the locking element or elements 20 is machined locally in the annular ring 16. Preferably, the annular ring 16 includes, on a bottom face, at least two reception openings 22 distributed over 360°. According to a preferential embodiment, the annular ring 16 includes four reception openings 22 distributed over 360°, the four reception openings 22 being spaced apart, two by two, by 90°. The annular ring 16 typically consists of a metallic material, for example steel or gold.

Figure 4:
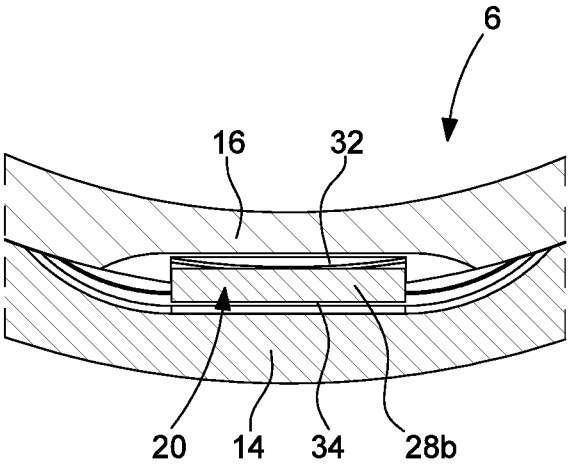
FIG. 4 is a view in cross section of the system of FIG. 2, taken along a cross-sectional plane IV-IV.

In the particular example embodiment illustrated in FIGS. 2 to 4, the annular joint 18 is driven between the annular ring 16 and each locking element 20. In the zones of the system 6 where there are no locking elements 20, the annular joint 18 is received in a groove 24 formed in the ring 16, as can be seen in FIG. 3. Preferably, the annular joint 18 consists of a polymer material, for example asutane. The annular joint 18 forms a friction element that prevents any sliding between the locking elements 20 and the annular ring 16, which also ensures non-return of the locking elements 20 when the latter are positioned in the system.

Figure 5:
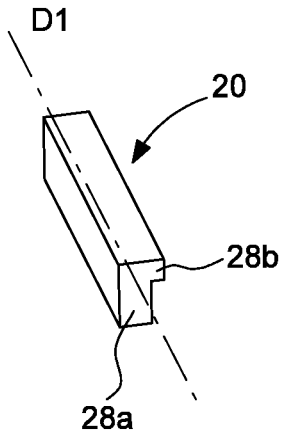
FIG. 5 is a perspective view of the locking system of FIG. 2.

Each locking element 20 is configured to lock any relative rotation between the annular ring 16 and the bezel 14. In the preferential example embodiment illustrated in FIGS. 2 and 5, each locking element 20 has a body elongate in a longitudinal extension direction Dl. The body has a first main part 28*a*, and a second part 28*b* forming a rim and extending from the first part 28*a* in a substantially orthogonal direction. As can be seen in FIGS. 2 and 5, the body thus has a substantially L-shaped cross section, the first part 28*a* of the body forming the main arm of the L, the second part 28*b* of the body forming the foot of the L. In order to receive the locking element or elements 20, the annular ring 16 has locally, on the top part thereof in line with a corresponding reception opening 22, at least one shoulder 30 defining an internal recess 32. Furthermore, the rotating bezel 14 defines locally, on its internal periphery, at least one internal groove 34. As can be seen in FIGS. 2 and 4, the second part 28*b* of each locking element 20 is received in one of the reception grooves 34 formed on the bezel 14. The top surface of the second part 28*b* of each locking element 20 is for its part in abutment against a bottom surface of the annular ring 16, or more precisely against a bottom surface of one of the shoulders 30, as illustrated in FIG. 2. Each locking element 20 thus makes it possible to angularly secure the assembly formed by the annular ring 16 and the bezel 14.

Preferably, each locking element 20 is formed from the same material as that from which the annular ring 16 is formed, typically a metallic material, for example steel or gold.

The assembly of the rotating bezel system 6 according to the invention will now be described with reference to FIGS. 6 to 11. It should be noted that, in these figures, the system 6 is shown upside down (with the bezel 14 turned over) compared with the normal positioning thereof as provided in operation and as shown in FIGS. 1 to 3. Consequently the terms "top" and "bottom" used hereinafter should be understood with regard to the orientations relating to the system 6 in FIGS. 1 and 3, rather than to the orientations relating to the system visible in FIGS. 6 to 11.

Figure 6:
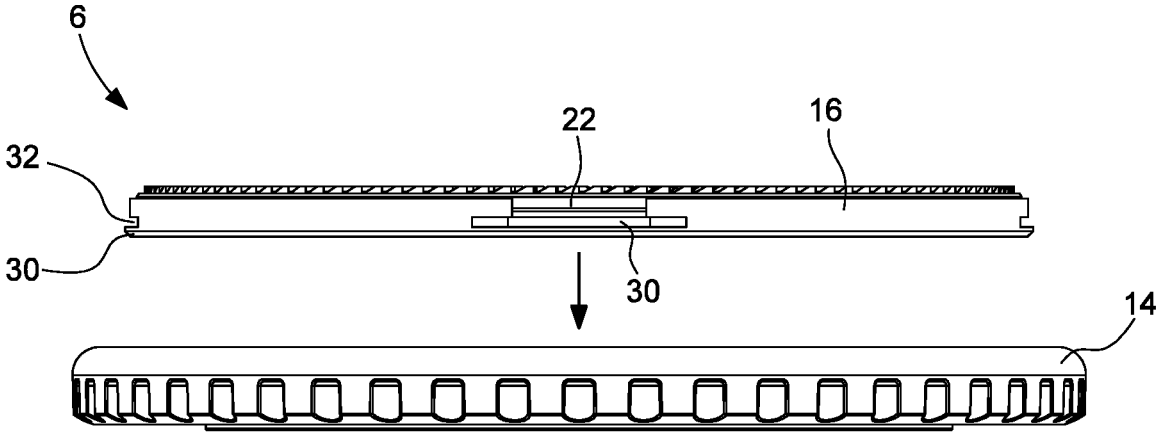
FIGS. 6 to 11 are views illustrating the various steps of assembling the rotating-bezel system according to the invention.
Figure 7:
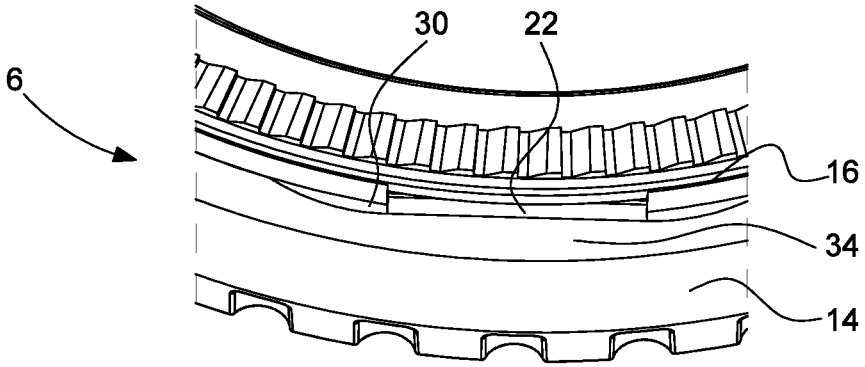

As illustrated in FIG. 6, the annular ring 16 is first of all installed by placing it in the previously positioned rotating bezel 14. To do this, and as shown in FIG. 7, the openings 22 and the shoulders 30 are used so as to be aligned with the internal grooves 34 of the bezel 14, thus ensuring correct positioning between the ring 16 and the bezel 14.

Figure 8:
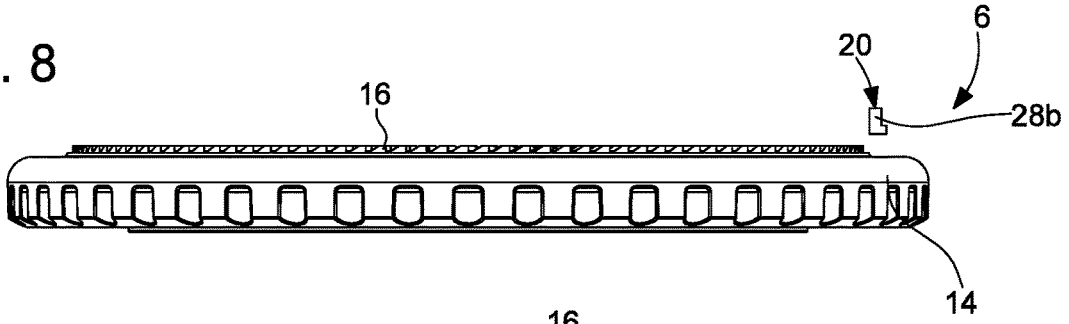
Figure 9:
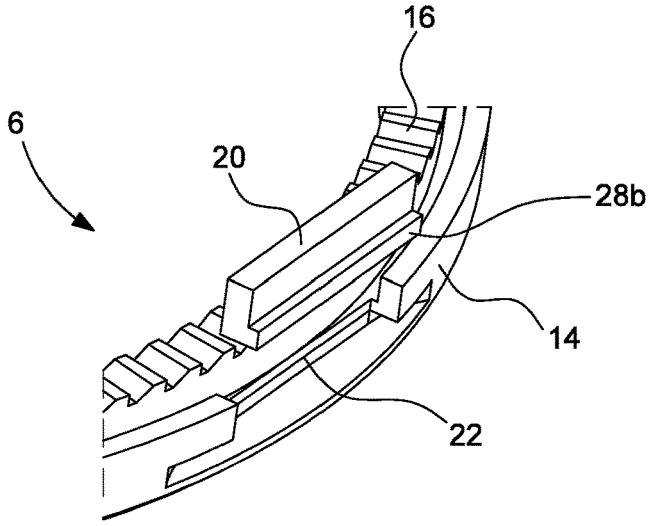
Figure 10:
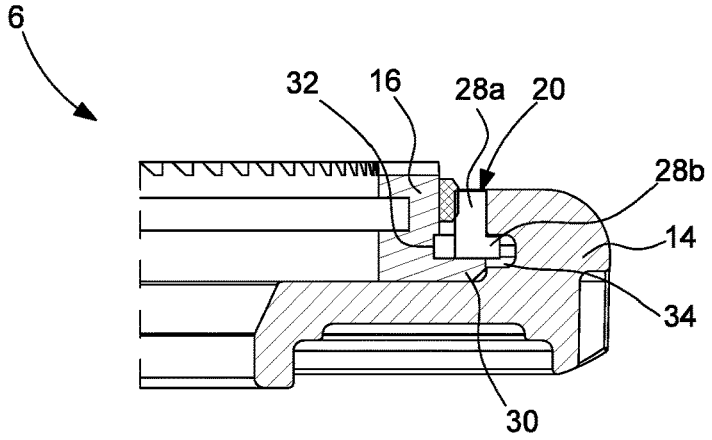

During a following step shown in FIGS. 8 and 9, each locking element 20 is inserted through one of the reception openings 22 formed in the ring 16, with the second part 28*b* forming the foot of the L positioned so as to be inserted first in the opening 22. This insertion is facilitated by the presence of the internal recess 32 defined by the corresponding shoulder 30 formed on the ring 16. As illustrated in FIG. 10, the second part 28*b* of each blocking element 20 is then slid into one of the internal grooves 34 formed in the bezel 14, the top surface of the second part 28*b* bearing against a bottom surface of the corresponding shoulder 30.

Figure 11:
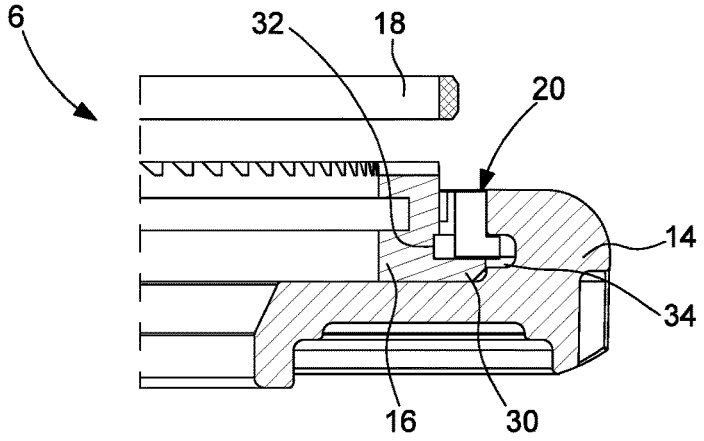

Finally, and as shown in FIG. 11, the annular joint 18 is placed in order to finalise the assembly of the system 6. To do this, the annular joint 18 is driven between the annular ring 16 and each locking element 20. In the zones of the system 6 where there are no locking elements 20, the annular joint 18 is received in the groove 24 formed in the ring 16, as can be seen in FIG. 3.

The invention claimed is:

1. A rotating-bezel system configured to be mounted for rotation on a middle of a watch case inside which a horological movement is housed, the rotating-bezel system comprising:

a ceramic rotating bezel;

an annular ring configured to cooperate with an element angularly secured to the middle;

an annular joint for connection between the rotating bezel and the annular ring, the annular ring being placed in the rotating bezel; and at least one locking element for locking the annular ring on the rotating bezel, said at least one locking element being configured to lock any relative rotation between the annular ring and the bezel and thus to angularly secure the assembly formed by the ring and the bezel, wherein a bottom face of the annular ring includes a reception opening for receiving the at least one locking element, wherein a top part of the annular ring in line with the reception opening includes a shoulder defining an internal recess, wherein an internal periphery of the rotating bezel includes an internal groove, wherein the at least one locking element has a body elongate in a longitudinal extension direction, the body having a substantially L-shaped cross section with a first part forming a main arm of the L-shape and a second part forming a foot of the L-shape, and wherein the second part is received in the internal groove of the rotating bezel and a top surface of the second part abuts a bottom surface of the shoulder of the annular ring.

2. The rotating-bezel system according to claim 1, wherein each locking element is formed from a same material as that from which the annular ring is formed.

3. The rotating-bezel system according to claim 1, wherein the system comprises at least two locking elements distributed over 360°.

4. The rotating-bezel system according to claim 3, wherein the system comprises four locking elements distributed over 360° the four locking elements being spaced apart, two by two, by 90°.

5. The rotating-bezel system according to claim 1, wherein the annular ring is a metal toothed ring.

6. The rotating-bezel system according to claim 1, wherein the annular joint is formed from a polymer material.

7. The rotating-bezel system according to claim 1, wherein at least one opening for receiving the at least one locking element is machined locally in the annular ring.

8. The rotating-bezel system according to claim 1, wherein the annular joint is driven between the annular ring and at least one locking element.

9. The rotating-bezel system according to claim 1, wherein said system is formed by an independent module, said module being configured to be snapped onto the middle.

10. A watch case comprising the rotating-bezel system according to claim 1.

11. A watch comprising the watch case according to claim 10.

* * * * *